US011338584B2

(12) United States Patent
Tanaka

(10) Patent No.: US 11,338,584 B2
(45) Date of Patent: May 24, 2022

(54) LIQUID EJECTION APPARATUS

(71) Applicant: CANON KABUSHIKI KAISHA, Tokyo (JP)

(72) Inventor: Yusuke Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/776,914

(22) Filed: Jan. 30, 2020

(65) Prior Publication Data

US 2020/0247128 A1 Aug. 6, 2020

(30) Foreign Application Priority Data

Jan. 31, 2019 (JP) ..... JP2019-015871

(51) Int. Cl.
*B41J 2/165* (2006.01)

(52) U.S. Cl.
CPC ..... *B41J 2/16535* (2013.01); *B41J 2/16505* (2013.01); *B41J 2/16532* (2013.01); *B41J 2/16544* (2013.01); *B41J 2/16547* (2013.01)

(58) Field of Classification Search
CPC ..... B41J 2/16505; B41J 2/16532; B41J 2/16535; B41J 2/16547
See application file for complete search history.

(56) References Cited

U.S. PATENT DOCUMENTS

| | | | | |
|---|---|---|---|---|
| 8,794,740 | B2 | 8/2014 | Hamano | 347/33 |
| 2008/0129776 | A1* | 6/2008 | Taira | B41J 2/16585 347/33 |
| 2012/0176444 | A1* | 7/2012 | Takeda | B41J 29/02 347/28 |
| 2013/0044159 | A1 | 2/2013 | Hamano | 347/33 |

FOREIGN PATENT DOCUMENTS

| | | |
|---|---|---|
| JP | 2000-190512 | 7/2000 |
| JP | 2001-322289 | 11/2001 |
| JP | 2007-050568 | 3/2007 |
| JP | 2008-087446 A | 4/2008 |
| JP | 2013-060003 | 4/2013 |
| JP | 2013-067087 A | 4/2013 |
| JP | 2018-134824 A | 8/2018 |

OTHER PUBLICATIONS

Office Action dated Jan. 5, 2021 in counterpart Japanese Application No. 2019-015871, together with English translation thereof.

* cited by examiner

*Primary Examiner* — Matthew Luu
*Assistant Examiner* — Kendrick X Liu
(74) *Attorney, Agent, or Firm* — Venable LLP

(57) ABSTRACT

Provided is a liquid ejection apparatus which, in a case of performing wiping operations at a plurality of different wiping pressures, can perform each wiping operation at a suitable wiping pressure and a suitable angle. To achieve this object, a liquid ejection apparatus is configured such that the angle of the wiping surface of a wiper to an ejection port surface can be changed while the wiper is out of contact with the ejection port surface and is not performing wiping, and the ejection port surface can be wiped with the wiper after the wiping surface angle is changed.

11 Claims, 15 Drawing Sheets

↓ PRINT AREA ↓

↓ PRINT AREA ↓

LIQUID EJECTION APPARATUS

BACKGROUND OF THE INVENTION

Field of the Invention

The present invention relates to a liquid ejection apparatus that ejects a liquid and in particular to a liquid ejection apparatus comprising a recovery mechanism that recovers an ejection condition.

Description of the Related Art

In Japanese Patent Laid-Open No. 2008-87446, in performing wiping to remove ink and dust attached to an orifice surface by wiping the orifice surface with a blade, the amount of feed of the blade toward the orifice surface is changed to vary the wiping pressure, or the pressure applied during the wiping. Specifically, disclosed is a configuration that increases the amount of feed of the blade to raise the wiping pressure when the blade wipes the nozzle portions in the orifice surface, and decreases the amount of feed of the blade to lower the wiping pressure when the blade gets separated from the orifice surface.

In the case where an orifice surface is wiped with a blade, the pressure of the wiping on the orifice surface is sometimes required to be changed according to the state of the ink attached to the orifice surface. On the other hand, the angle of the blade to the orifice surface during the wiping is required to be an angle within a suitable range irrespective of the magnitude of the pressure. However, in the method of Japanese Patent Laid-Open No. 2008-87446, the wiping pressure (pressure) inevitably determines the angle of the blade. Hence, in a case where the pressure of the wiping is changed, the angle of the blade changes according to the pressure. This leads to a problem in that it is difficult to perform wiping within a suitable angle range.

SUMMARY OF THE INVENTION

In view of the above, the present invention provides a liquid ejection apparatus which, in a case of performing wiping operations at different pressures, can perform each wiping operation while maintaining a suitable angle and pressure to an ejection port surface.

In an aspect of the present invention, there is provided, a liquid ejection apparatus comprising: a print head having an ejection port surface in which an ejection port for ejecting a liquid is provided; a wiper that has a wiping surface capable of contacting with the ejection port surface and performs a wiping operation of wiping the ejection port surface via relative movement between the wiper and the print head; an angle changing unit configured to change a fixed angle of the wiping surface to the ejection port surface in a state where the wiping surface is out of contact with the ejection port surface; wherein a distance to the ejection port surface from a tip of the wiper is changed in the state where the wiping surface is out of contact with the ejection port surface.

According to the present invention, it is possible to implement a liquid ejection apparatus which, in a case of performing wiping operations at different pressures, can perform each wiping operation while maintaining a suitable angle and pressure to an ejection port surface.

Further features of the present invention will become apparent from the following description of exemplary embodiments with reference to the attached drawings.

DESCRIPTION OF THE EMBODIMENTS

First Embodiment

A first embodiment of the present invention will be described below with reference to drawings.

Figure 1:
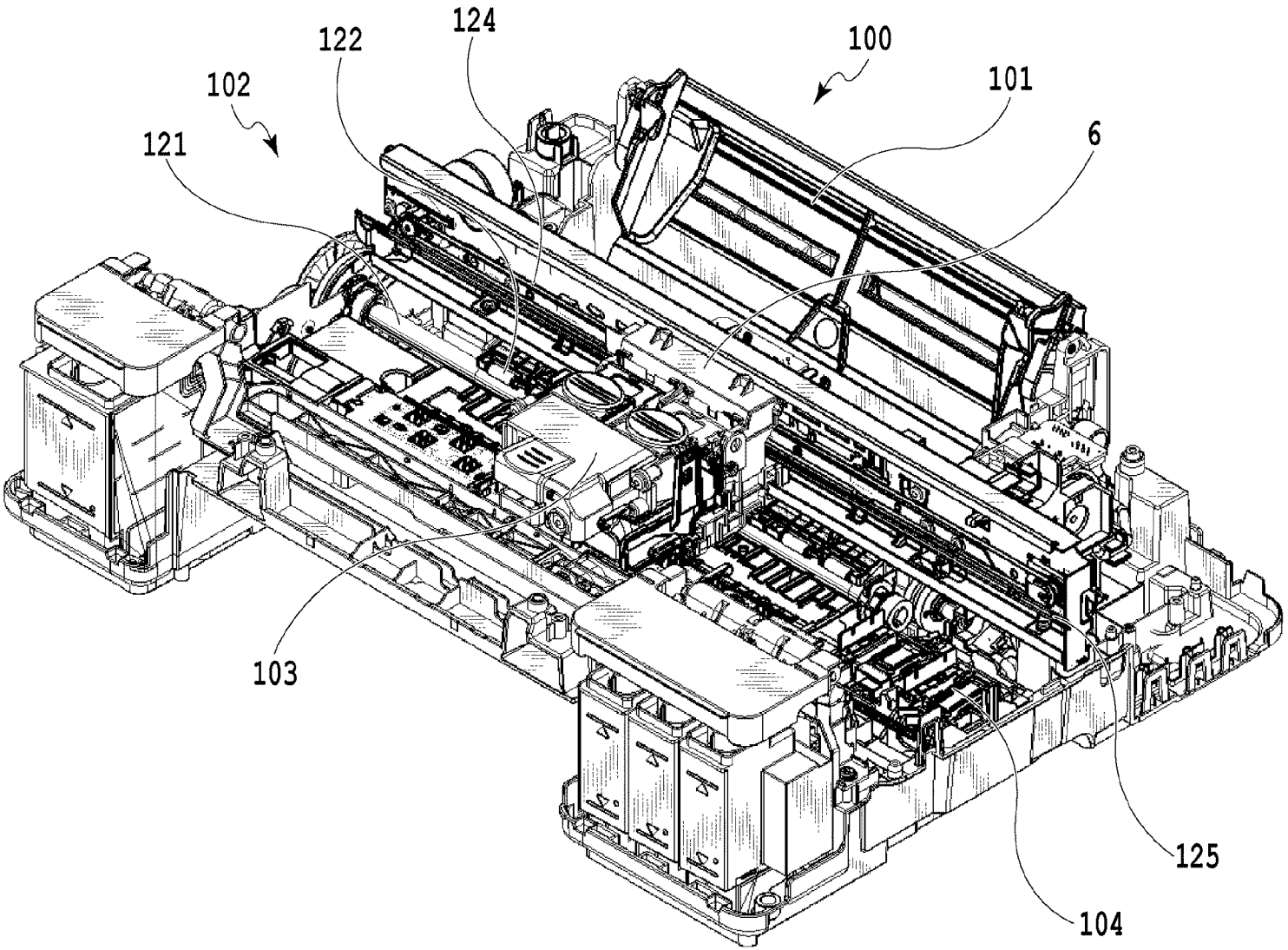
FIG. 1 is a perspective view showing a liquid ejection apparatus.

FIG. 1 is a perspective view showing a liquid ejection apparatus 100 in the present embodiment. The liquid ejection apparatus 100 comprises a sheet feeding unit 101 that feeds a print medium into the apparatus, a conveyance unit 102 that conveys the fed print medium, a print unit 103 that performs printing on the print medium, and a recovery mechanism 104 that recovers performance of the print unit 103.

The sheet feeding unit 101 comprises a sheet feeding tray on which to load print media. The print media loaded on the sheet feeding tray are separated and fed one by one by a sheet feeding roller driven by a sheet feeding motor to be supplied to the conveyance unit 102. The conveyance unit 102 conveys the supplied print medium to the print unit 103 by pinching it with a conveyance roller 121 driven by a conveyance motor and a pinch roller 122 driven by the conveyance roller 121. The print unit 103 obtains image information from a connected computer and performs printing on the print medium by ejecting a liquid(s) (hereinafter referred to as "ink(s)") from a print head(s) based on the obtained image information. The recovery mechanism 104 maintains or recovers the ink ejection performance of the print heads in order to maintain the quality of images to be printed. The print medium after the printing is pinched and conveyed by a sheet discharge roller driven in synchronization with the conveyance roller 121 and a spur roller to be discharged to the outside of the apparatus.

The print unit 103 comprises a carriage 6 capable of reciprocally moving in a main scanning direction, and print cartridges mounted on the carriage 6 and having the print heads. The carriage 6 is guided and supported to be capable of reciprocally moving in the main scanning direction along a guide rail installed in the apparatus main body. In the present embodiment, the main scanning direction of the carriage and the direction of conveyance of a print medium by the conveyance unit 102 are perpendicular to each other. The reciprocal movement of the carriage 6 is performed via a carriage belt 124 with a carriage motor as a drive source. In the liquid ejection apparatus 100, control is performed by detecting the position and speed of the carriage 6 with an encoder sensor mounted on the carriage 6 and an encoder scale laid on the apparatus main body side. Printing is performed on a print medium from the print head by repeating a printing operation of the print head performed in synchronization with movement of the carriage 6 in a print area and conveyance of the print medium by a predetermined pitch.

The recovery mechanism 104 comprises a wiping mechanism that wipes the ejection port surfaces of the print heads in which ejection ports for ejecting the liquids are provided, a capping mechanism that covers the ejection port surfaces, a pump mechanism that sucks the inks from the ejection ports, and so on. The recovery mechanism 104 comprises a slider which, as the carriage 6 moves toward the recovery mechanism 104, can move within a predetermined range by following the movement of the carriage 6. The slider is equipped with wipers included in the wiping mechanism and caps included in the capping mechanism. Details of this slider will be described later.

Figure 2:
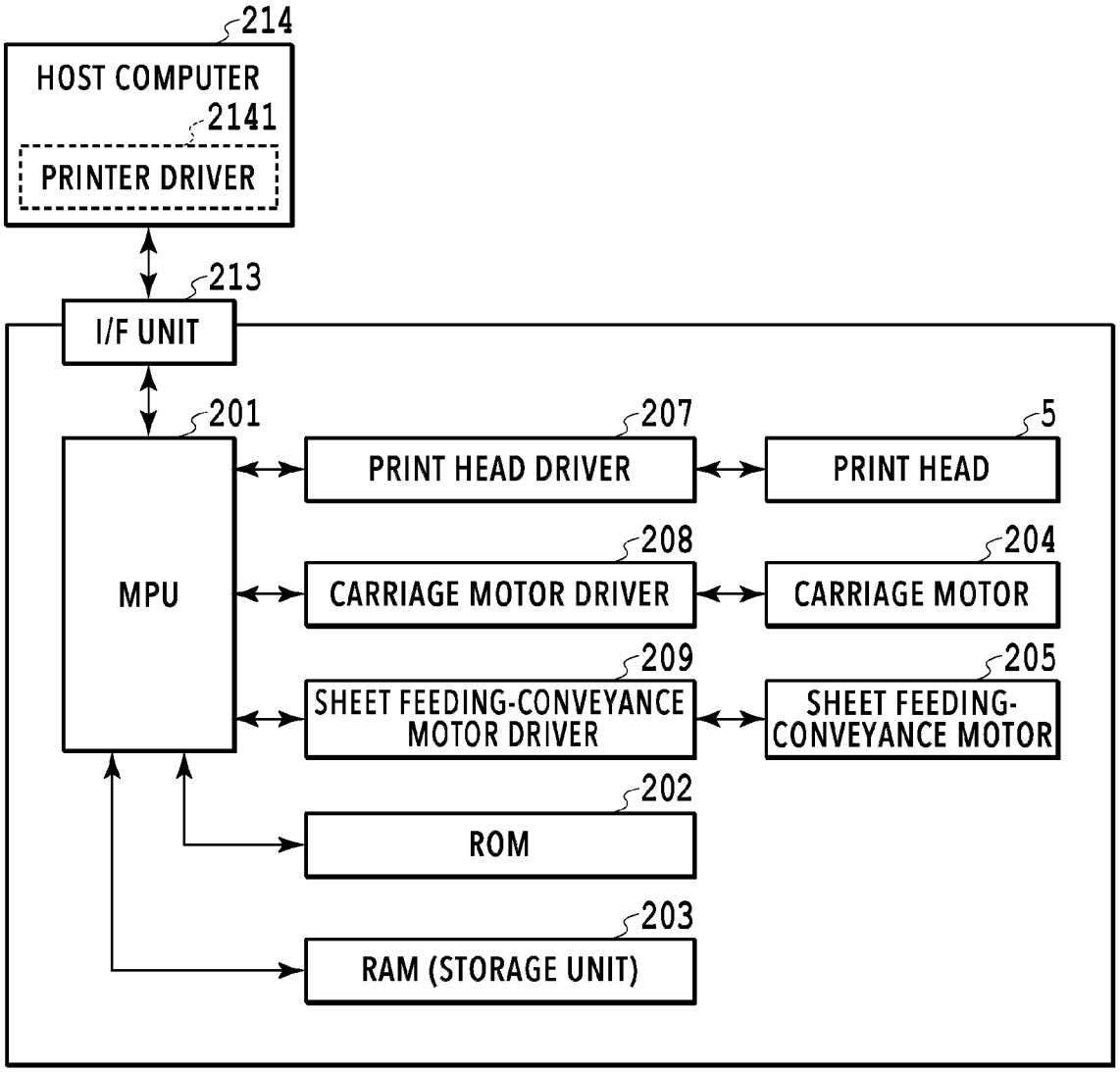
FIG. 2 is a block diagram of a control system in the liquid ejection apparatus.

FIG. 2 is a block diagram of a control system in the liquid ejection apparatus 100. The liquid ejection apparatus 100 is connected to a printer driver 2141 of a host computer 214 via an I/F unit 213. Inside the liquid ejection apparatus 100, the I/F unit 213 and an MPU 201 that controls the operations of components, data processing, and so on are connected to each other. The MPU 201 is connected to an ROM 202 that stores programs to be executed by the MPU 201 and data and to an RAM 203 that temporarily stores data of processes to be executed by the MPU 201 and data received from the host computer 214.

The MPU 201 is further connected to a print head driver 207, a carriage motor driver 208, and a sheet feeding-conveyance motor driver 209. The print head driver 207 controls print heads 5. The carriage motor driver 208 controls a carriage motor 204 that drives the carriage 6. The sheet feeding-conveyance motor driver 209 controls a sheet feeding-conveyance motor 205.

The host computer 214 is provided with the printer driver 2141, which, in response to a command to execute a printing operation issued by the user, gathers the image to be printed and print information such as the quality of the image to be printed and communicates them with the printing apparatus. The MPU 201 executes exchange of the image to be printed, etc. and so on with the host computer 214 via the I/F unit 213.

Figure 3:
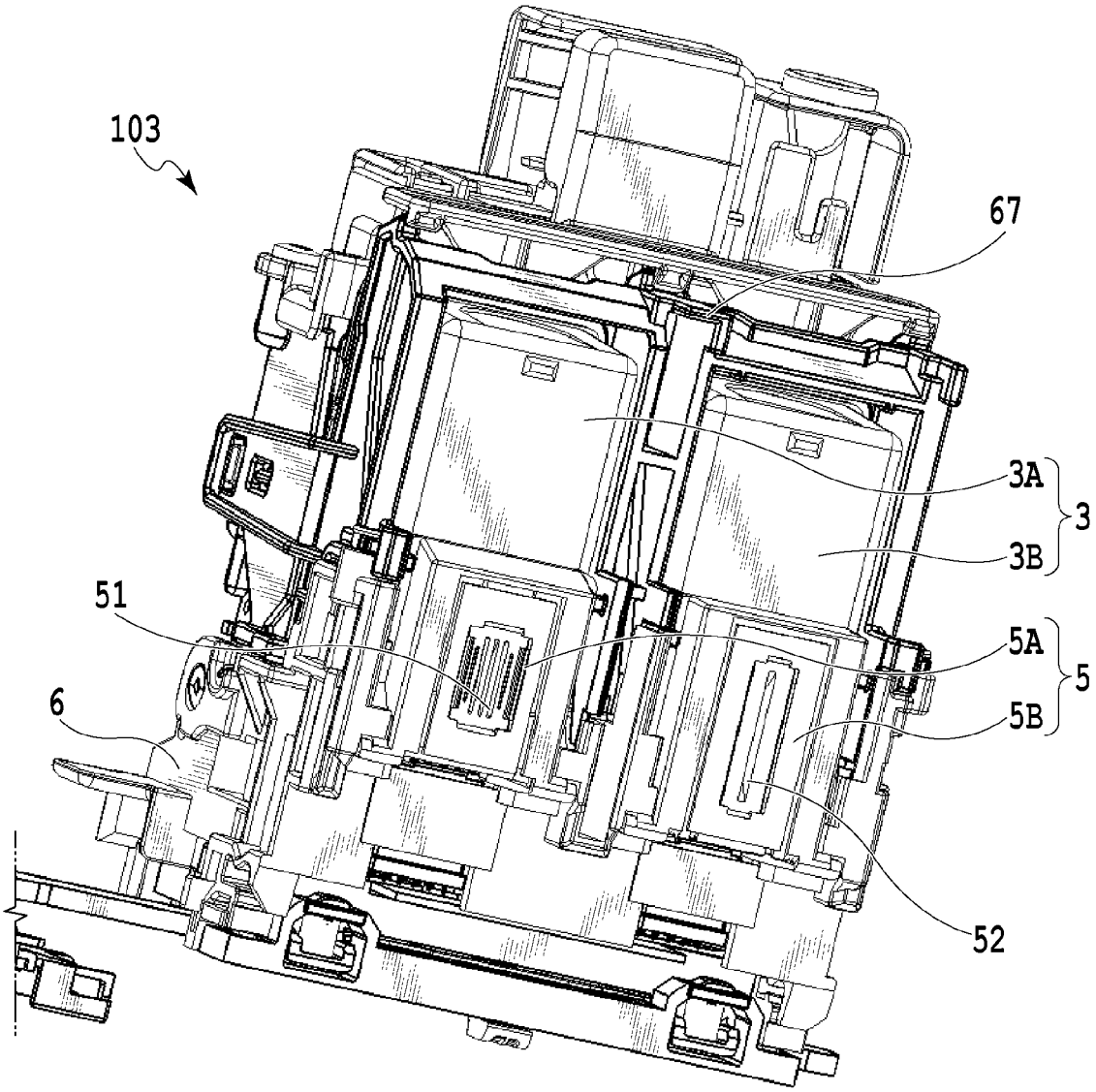
FIG. 3 is a view showing a print unit.

FIG. 3 is a view showing the print unit 103. The print unit 103 comprises the carriage 6 and print cartridges 3. The carriage 6 carries two print cartridges, namely, a chromatic-color print cartridge 3A and a monochromatic print cartridge 3B. Each print cartridge 3 is configured integrally with the corresponding print head 5 and ink tank(s). The chromatic-color print cartridge 3A comprises a print head 5A for chromatic colors that ejects inks of three colors, e.g., cyan, magenta, and yellow. The monochromatic print cartridge 3B comprises a print head 5B that performs printing by using an ink of a single color (e.g., black). Ejection port arrays for the inks of the three colors of cyan, magenta, and yellow are formed in an ejection port surface 51 of the print head 5A in which ejection ports for ejecting the inks are formed. Also, an ejection port array for ejecting the ink of the single color, such as black, is formed in an ejection port surface 52 of the print head 5B. Note that the configuration is not limited to the one in which each print cartridge 3 and the corresponding print head 5 are integrated with each other, but they may be configured as separate components. Further, the print head 5A, which ejects the inks of the three colors, and the print head 5B, which ejects the ink of the single color, may be formed integrally with each other.

Figure 4:
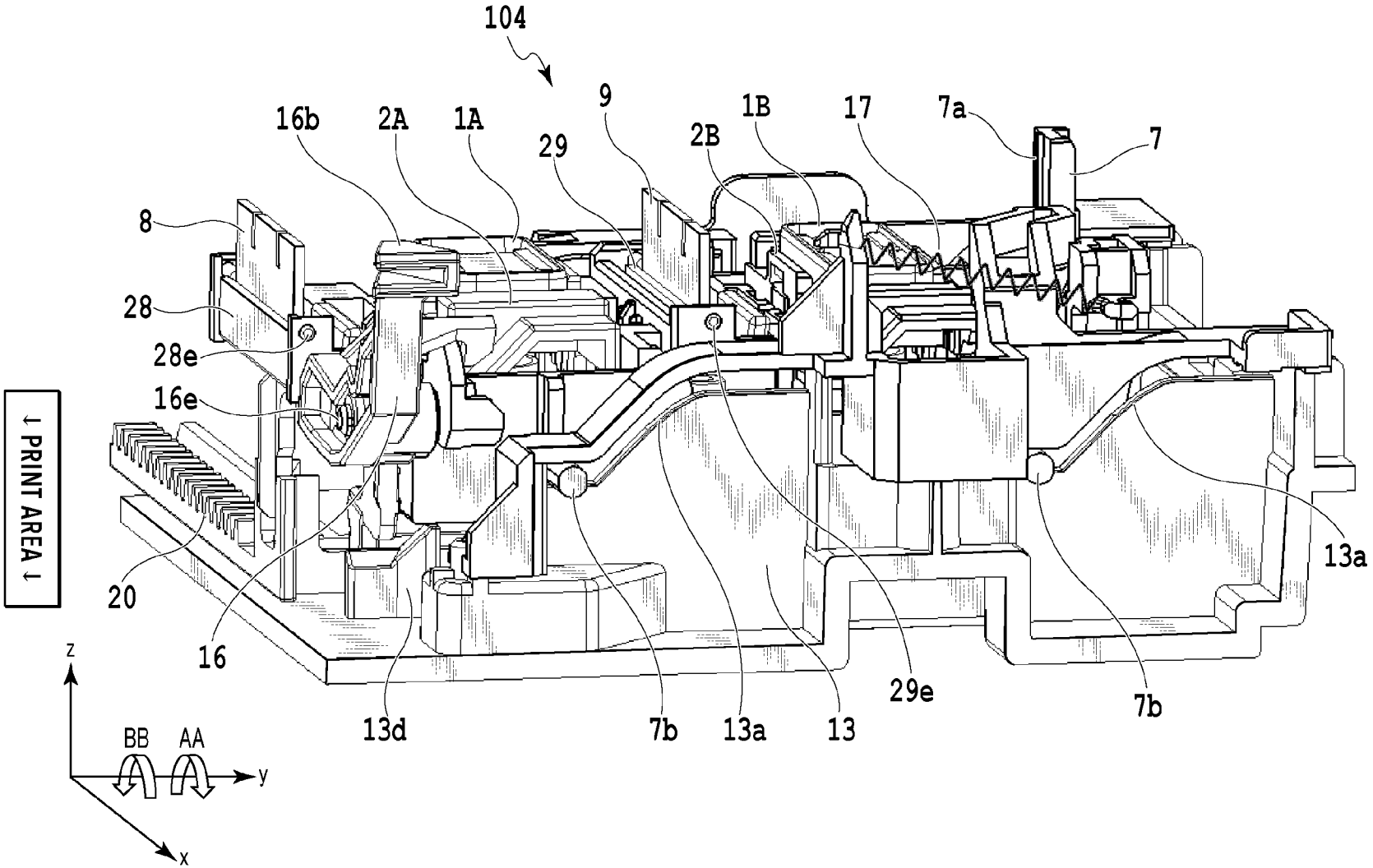
FIG. 4 is a perspective view showing a recovery mechanism.

FIG. 4 is a perspective view showing the recovery mechanism 104. The recovery mechanism 104 performs a recovery process that maintains the ink ejection from the print heads 5A and 5B in a good condition. The recovery process is performed in a state where the print heads 5 of the print cartridges 3, mounted on the carriage 6, and a slider 7 included in the recovery mechanism 104 are disposed at such positions as to each other. The recovery process includes: a recovery process called wiping which involves wiping the ejection port surfaces 51 and 52 of the print heads 5A and 5B with wipers 8 and 9; and a suction recovery process which involves covering the ejection port surfaces 51 and 52 with caps 1A and 1B and depressurizing the inside of the caps 1A and 1B to suck the inks in the ejection ports. The wiper 8 and the cap 1A are for the ejection port surface 51, and the wiper 9 and the cap 1B are for the ejection port surface 52. Generally, in a case where the suction recovery process is performed, the wiping is also performed.

The recovery mechanism 104 comprises the wipers 8 and 9, the caps 1A and 1B, and so on, and comprises the slider 7, which is capable of sliding to a retreat position, a wiping position, and a capping position. The wipers 8 and 9 are each formed of a plate-shaped flexible member. The slider 7 is provided with a hitting portion 7*a* capable of contacting a side surface of the carriage 6 so that the slider 7 can move within a predetermined range by following movement of the carriage 6. The recovery mechanism 104 is provided next to the print area where printing is performed. As the carriage 6 moving in a y direction from the print area and the hitting portion 7*a* of the slider 7 contact each other, the slider 7 slides in the y direction. This enables the slider 7 to move from the retreat position to the wiping position and the capping position. Note that FIG. 4 shows a state where the slider 7 is at the retreat position. Meanwhile, since the slider 7 moves by following movement of the carriage 6 as mentioned above, the carriage 6 should be illustrated depending on the state of the slider 7 to be described below, but the illustration of the carriage 6 is omitted to clearly show the configuration of the slider 7.

The retreat position is a position at which the wipers 8 and 9 and the caps 1A and 1B are separated from the print heads 5. The wiping position is a position at which the wipers 8 and 9 can wipe the ejection port surfaces 51 and 52 of the print heads 5. In a state where the slider 7 is at the wiping position, the wiping of the ejection port surfaces 51 and 52 is performed via relative movement between the carriage 6 and the slider 7. Also, the capping position is a position at which the caps 1A and 1B can cover the ejection port surfaces 51 and 52 of the print heads 5. Details of the wiping operation performed at the wiping position will be described later.

At four positions on its side surfaces, the slider 7 is provided with protrusion portions 7*b* protruding in a direction perpendicular to (crossing) the movement direction of the carriage 6. FIG. 4 shows the protrusion portions 7*b* at two positions. The protrusion portions 7*b* are in contact with respective slider cams 13*a* provided to an apparatus main body 13, and the slider 7 is urged in a −y direction by a slider spring 17 laid in a stretched state between the apparatus main body side and the slider 7. The slider 7 moves with the protrusion portions 7*b* sliding along the cam surfaces of the slider cams 13*a*, and the wiper 8 moves along the shape of the slider cams 13*a* toward or away from a plane including the path of movement of the ejection port surface 51, which moves along with the carriage 6. The cam surfaces of the slider cams 13*a* are formed so as to set the slider 7 at a predetermined height relative to the carriage 6 at each of positions such as the retreat position, the wiping position, and the capping position, which are provided along the movement direction of the carriage 6.

The wiper 8, which wipes the ejection port surface 51 of the color print head 5A, and the wiper 9, which wipes the ejection port surface 52 of the black print head 5B, are attached to the slider 7 via respective wiper holders 28 and 29. Also, the caps 1A and 1B, which cap the ejection port surfaces 51 and 52 of the print heads 5, are attached to respective cap holders 2A and 2B, and each of the cap holders 2A and 2B is attached to the slider 7 via claw portions at four positions. A cap spring not shown is disposed between each of the cap holders 2A and 2B and the slider 7, and the cap holders 2A and 2B with the caps 1A and 1B attached thereto are urged toward the ejection port surfaces 51 and 52. The wipers 8 and 9 and the caps 1A and 1B are disposed in order of the wiper 8, the cap 1A, the wiper 9, and the cap 1B from the print area side in FIG. 4.

The slider 7 comprises a lock lever 16 as a locking member that locks the slider 7 at the wiping position. The lock lever 16 is attached to the slider 7 so as to be pivotable to a locking position at which the lock lever 16 locks the slider 7 at the wiping position and a release position at which the lock lever 16 releases the lock on the slider 7. The lock lever 16 restricts movement of the slider 7 in the −y direction in a case where the carriage 6 moves to the wiping position to wipe the ejection port surfaces 51 and 52 of the print heads 5 with the wipers 8 and 9.

Figure 5A:
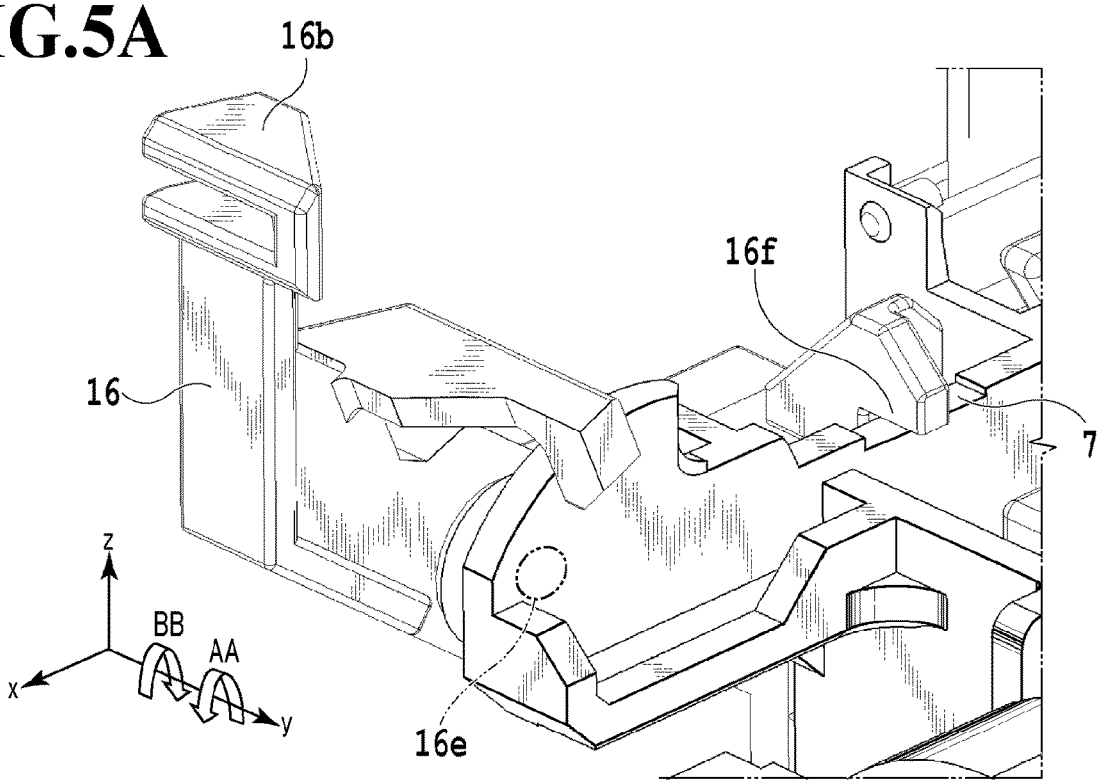
FIG. 5A is a view showing a lock lever.
Figure 5B:
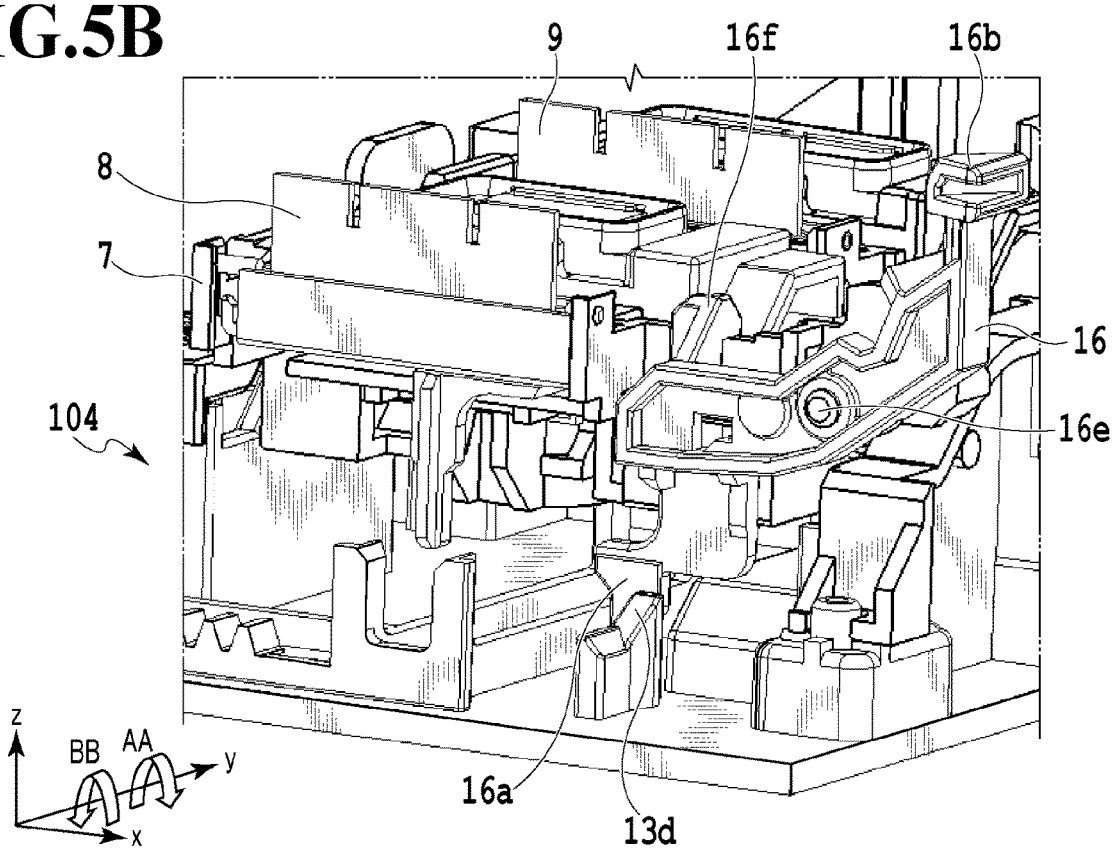
FIG. 5B is a view showing a slider.

FIGS. 5A and 5B are views showing the lock lever 16 and the slider 7 with the slider 7 at the wiping position, and show a state where the lock lever 16 is restricting movement of the slider 7 at the wiping position. The lock lever 16 is supported so as to be pivotable about a support shaft 16*e* in the direction of arrow AA or in the direction of arrow BB. An urging force in the direction of arrow BB generated by a spring not shown is exerted on the lock lever 16, so that the lock lever 16 is pivoted in the direction of arrow BB unless an external torque of a predetermined value or more is applied. In the state where the slider 7 is at the capping position or the wiping position, a protrusion portion 16*f* of the lock lever 16 is in contact with the slider 7 as shown in FIG. 5A, thereby restricting pivotal movement of the lock lever 16. In particular, in the case where the slider 7 at the wiping position, a tip portion 16*a* of the lock lever 16 is in contact with a locking portion 13*d* (see FIG. 5B), thereby restricting movement of the slider 7 in the −y direction from the wiping position. Note that in the case where the slider 7 is at the capping position, the carriage 6 is in contact with the hitting portion 7*a*, thereby restricting movement of the slider 7 in the −y direction from the capping position.

The carriage 6 is provided with an unlocking protrusion portion 67 capable of contacting an upper end portion 16*b* of the lock lever 16 (see FIG. 3). The protrusion portion 67 contacts the upper end portion 16*b* of the lock lever 16 as the carriage 6 moves in the −y direction toward the print area (see FIG. 4) from the state where the lock lever 16 restricts movement of the slider 7 from the wiping position. As a result, the lock lever 16 pivots in the direction of arrow AA and the tip portion 16*a* of the lock lever 16 gets separated from the locking portion 13*d*, thereby releasing the lock. With the lock by the lock lever 16 released, the slider 7 is moved toward the retreat position by the effect of the slider spring 17.

Figure 6:
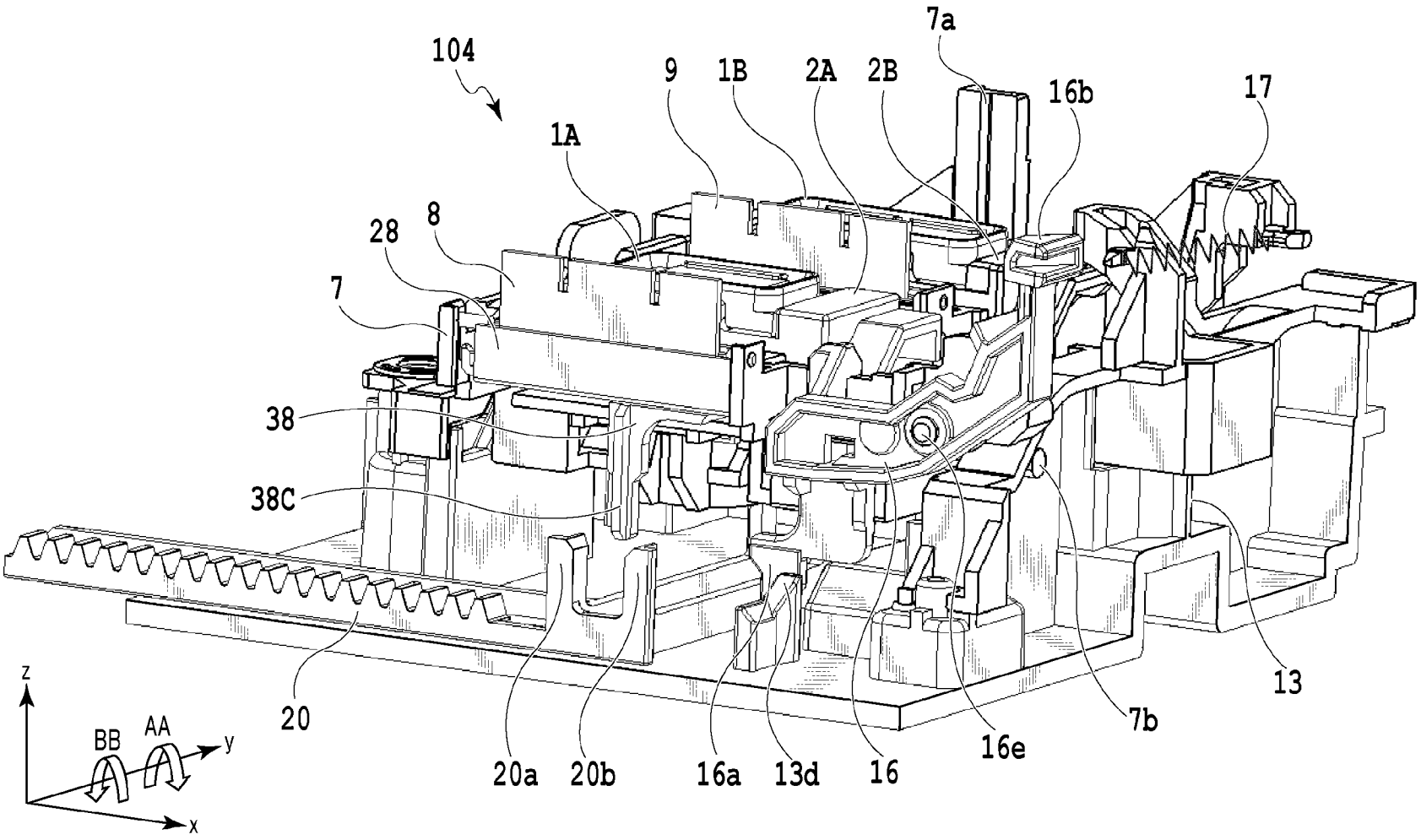
FIG. 6 is a view showing the recovery mechanism with the slider at a wiping position.

FIG. 6 is a view showing the recovery mechanism 104 with the slider 7 at the wiping position. FIGS. 7A to 7D are views showing the wiper 8, the wiper holder 28, and an adjuster 38. The adjuster 38 is supported on the slider 7 so as to be slidable in ±x directions. As the adjuster 38 slides, a cam surface of the wiper holder 28 in contact with a contact portion 38*a* of the adjuster 38 switches from a cam surface 28*a* to a cam surface 28*b* (see FIGS. 7B and 7D). This enables the orientation of the wiper 8 to be changed between a substantially perpendicular state and a tilted state relative to the ejection port surface. With the contact portion 38*a* and the cam surface 28*a* in contact with each other, the wiper 8 and the wiper holder 28 are substantially perpendicular to the ejection port surface. With the contact portion 38*a* and the cam surface 28*b* in contact with each other, the wiper 8 and the wiper holder 28 are tilted relative to the ejection port surface.

The apparatus main body 13 is provided with an adjustment slider (angle changing unit) 20 that causes the adjuster 38 to slide. As the adjustment slider 20 moves in the x direction or the −x direction, either a protrusion portion 20*a* or a protrusion portion 20*b* of the adjustment slider 20 contacts a tip portion 38*c* of the adjuster 38 and slides the adjuster 38 in the x direction or the −x direction. Such movement of the adjustment slider 20 enables the orientations of the wiper 8 and the wiper holder 28 to be changed. Note that the adjustment slider 20 is configured to contact the tip portion 38*c* of the adjuster 38 in the state where the slider 7 is at the retreat position.

Note that the configuration of the wiper holder 29, to which the wiper 9 is attached, is similar to the configuration of the wiper holder 28, to which the wiper 8 is attached. Thus, only the wiper 8 and the wiper holder 28 will be described below, and description of the wiper 9 and the wiper holder 29 will be omitted.

Figure 7A:
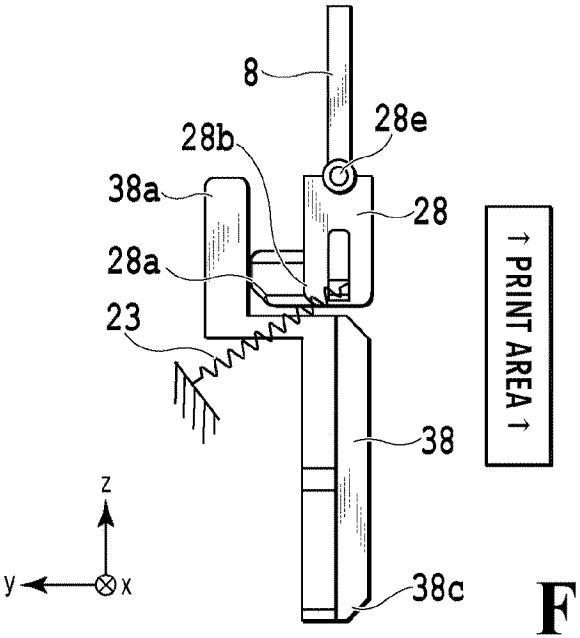
FIG. 7A is a view showing a wiper, a wiper holder, and an adjuster.
Figure 7B:
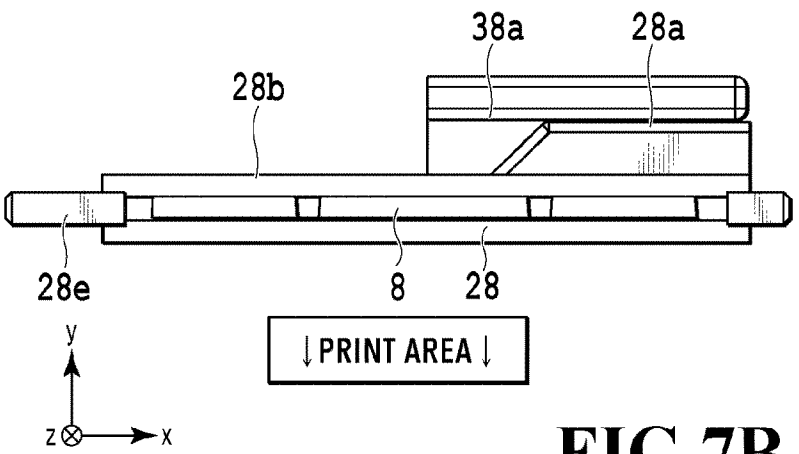
FIG. 7B is a view showing the wiper, the wiper holder, and the adjuster.
Figure 7C:
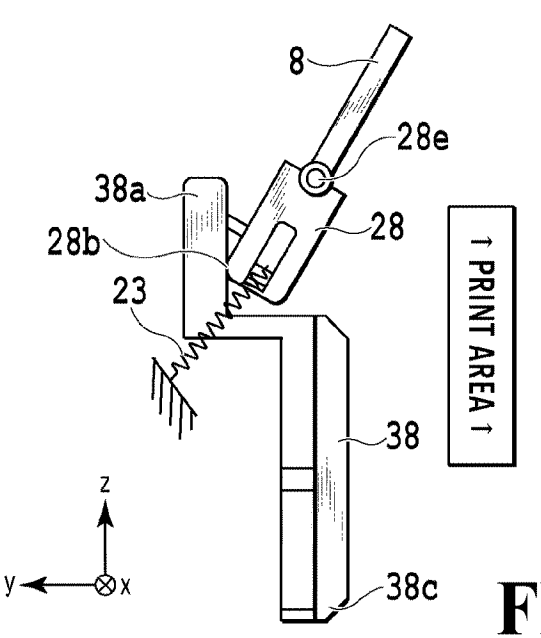
FIG. 7C is a view showing the wiper, the wiper holder, and the adjuster.
Figure 7D:
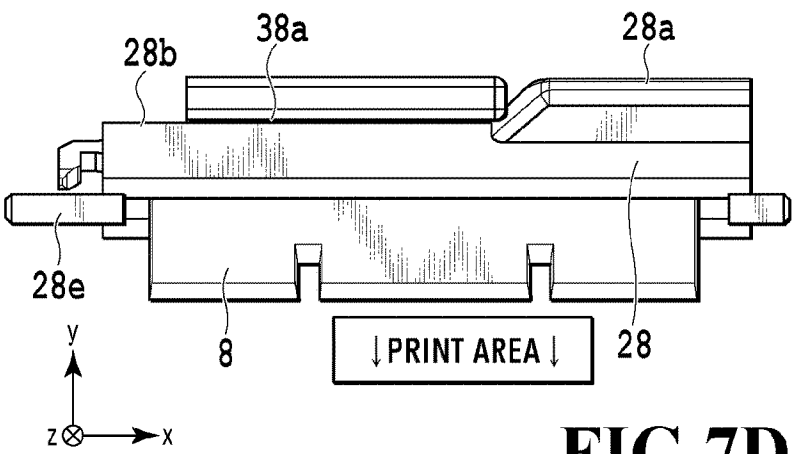
FIG. 7D is a view showing the wiper, the wiper holder, and the adjuster.

FIGS. 7A and 7B show the state where the contact portion 38*a* of the adjuster 38 and the cam surface 28*a* of the wiper holder 28 are in contact with each other. In this state, the wiper 8 is substantially perpendicular to the ejection port surface 51 in a case where the carriage 6 has moved to and is present at a position at which it faces the slider 7. On the other hand, FIGS. 7C and 7D show the state where the contact portion 38*a* of the adjuster 38 and the cam surface 28*b* of the wiper holder 28 are in contact with each other. In this state, the wiper 8 is tilted relative to the ejection port surface 51 in a case where the slider 7 is located at the wiping position and the carriage 6 has moved to and is located at a position at which it faces the slider 7.

The recovery process involving suction is performed with the wiper 8 substantially perpendicular to the ejection port surface 51 as shown in FIGS. 7A and 7B. The recovery process not involving suction is performed with the wiper 8 tilted relative to the ejection port surface 51 as shown in FIGS. 7C and 7D. Details of these processes will be described later.

The wiper holder 28, which holds the wiper 8, comprises a support shaft 28*e* and is provided so as to be pivotable about the support shaft 28*e*. The wiper holder 28 is urged at its lower end portion in a predetermined direction by a tension spring 23, and its orientation is maintained by the urging force of the tension spring 23 unless an external torque of a predetermined value or more is applied. The adjuster 38 is attached to the slider 7, and the contact between the contact portion 38*a* of the adjuster 38 and the cam surface 28*a* or 28*b* of the wiper holder 28 determines the orientation of the wiper holder 28.

Figure 8:
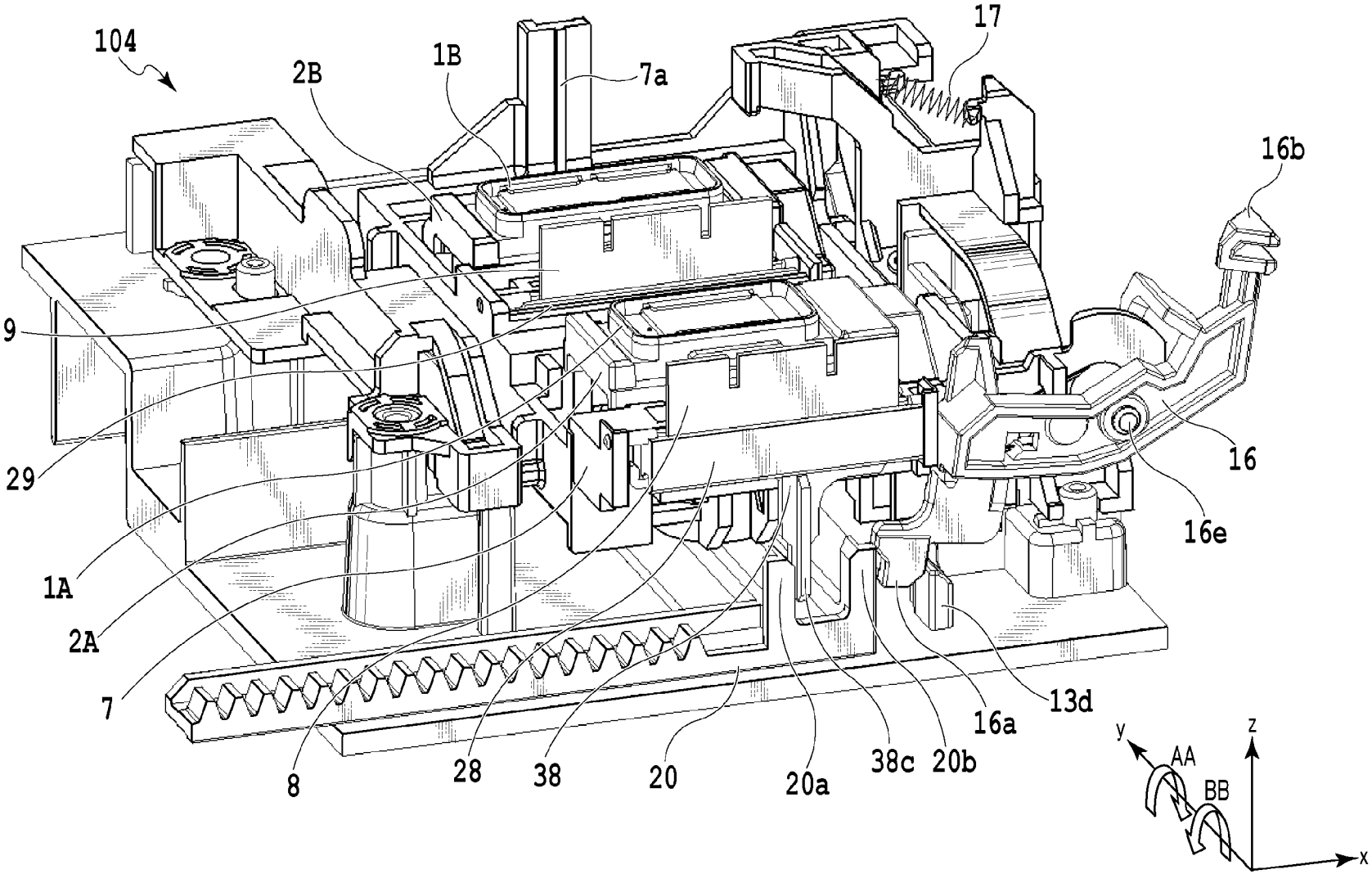
FIG. 8 is a perspective view showing the recovery mechanism with the slider at a retreat position.

FIG. 8 is a perspective view showing the recovery mechanism 104 with the slider 7 at the retreat position. In a case where the carriage 6 is in the print area and is therefore not at a position at which it faces the recovery mechanism 104 after the recovery process, during a printing operation, or the like, the lock lever 16 is located at the release position to which it has been pivoted in the direction of arrow AA from the locking position. In this case, the tip portion 16*a* of the lock lever 16 is in contact with the locking portion 13*d* but does not restrict movement of the slider 7 in the −y direction. Specifically, the tip portion 16*a* is in contact with a surface of the locking portion 13*d* different from the surface in the case where the slider 7 is at the wiping position, so that the lock lever 16 does not restrict the movement of the slider 7.

In this state, the locking portion 13*d* restricts pivotal movement of the lock lever 16 in the direction of arrow BB and the protrusion portions 7*b* of the slider 7 are in contact with end portions of the cam surfaces of the slider cams 13*a*, so that the slider 7 is located at the retreat position and restricted from moving in the −y direction. In FIG. 8, the slider 7 is at the retreat position. Thus, sliding the adjustment slider 20 in this state enables it to contact the tip portion 38*c* of the adjuster 38 and change the orientation of the wiper holder 28.

Figure 9A:
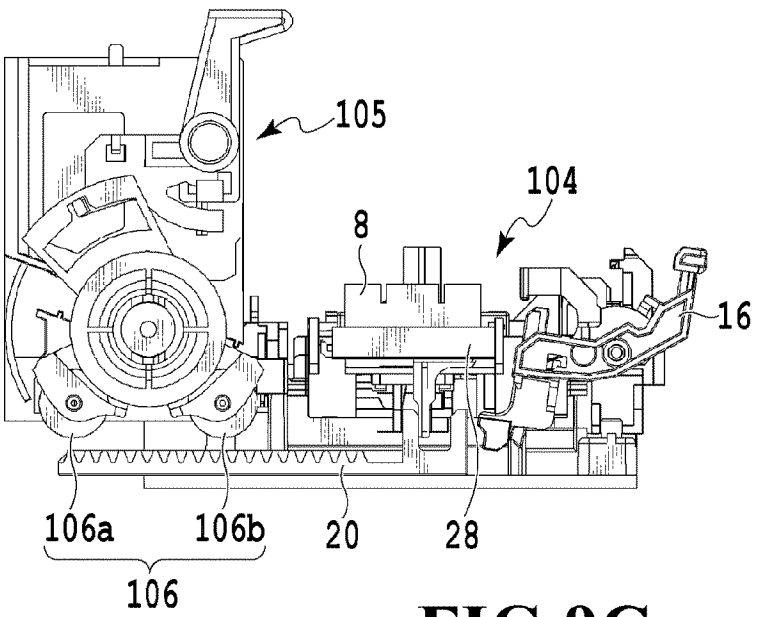
FIG. 9A is a view showing a wiper fixed angle switching mechanism.
Figure 9B:
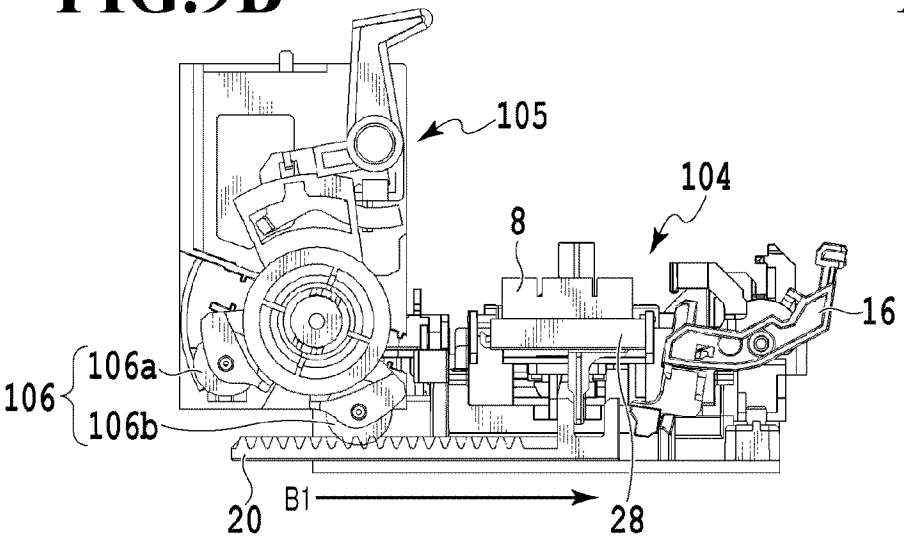
FIG. 9B is a view showing the wiper fixed angle switching mechanism.
Figure 9C:
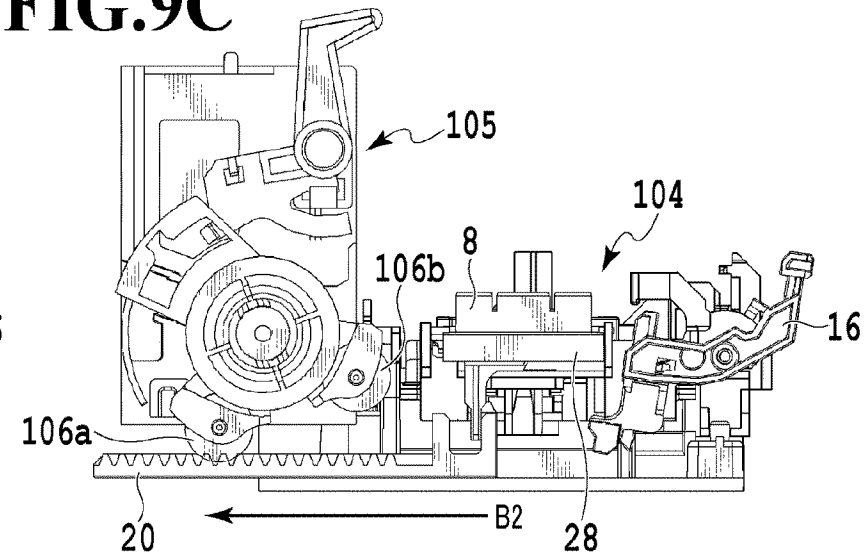
FIG. 9C is a view showing the wiper fixed angle switching mechanism.

FIGS. 9A to 9C are views showing a wiper fixed angle switching mechanism that changes the orientation of the wiper holder 28 by sliding the adjustment slider 20. Note that the slider 7 is located at the retreat position in FIGS. 9A to 9C.

The liquid ejection apparatus 100 comprises an angle switching drive transmission unit 105 as a drive transmission mechanism that slides the adjustment slider 20. The angle switching drive transmission unit 105 transmits drive of the conveyance roller 205 to the adjustment slider 20 while the carriage 6 is at an angle switching position being a position which is on the recovery mechanism side relative to the print area and at which the side surface of the carriage 6 and the hitting portion 7*a* of the slider 7 do not contact each other.

In a case where the carriage 6 is not at the angle switching position, the drive of the angle switching drive transmission unit 105 is off, as shown in FIG. 9A. In this state, drive gears 106 of the angle switching drive transmission unit 105 are separated from a rack portion of the adjustment slider 20, so that no drive force is transmitted to the adjustment slider 20. In this state, the wiper 8, which is attached to the wiper holder 28, is held in such an orientation that the wiper 8 will be at approximately 90 degrees to the ejection port surface 51 in a case where the carriage 6 moves and the wiper 8 faces the ejection port surface 51.

As the carriage 6 moves to the angle switching position, the drive of the angle switching drive transmission unit 105 is on, as shown in FIGS. 9B and 9C. In the state of FIG. 9B, a drive gear 106*b* of the angle switching drive transmission unit 105 is engaged with the rack portion of the adjustment slider 20 and therefore transmits drive force to the adjustment slider 20 to thereby slide the adjustment slider 20 in the direction of arrow B1. Note that shifting from the state of FIG. 9A to the state of FIG. 9B does not cause the adjustment slider 20 to slide since it has already moved in the direction of arrow B1, so that the angle of the wiper 8 remains at approximately 90 degrees.

In the state of FIG. 9C, a drive gear 106*a* of the angle switching drive transmission unit 105 is engaged with the rack portion of the adjustment slider 20 and therefore transmits drive force to the adjustment slider 20 to thereby slide the adjustment slider 20 in the direction of arrow B2. In this state, the wiper 8, which is attached to the wiper holder 28, is held in an orientation of approximately 70 degrees. Note that an angle of 70 degrees is employed as the tilt angle of the wiper in the present embodiment but the angle is not limited to this angle. It is preferable to change the angle as appropriate according to the material of the wiper and so on.

Figure 10A:
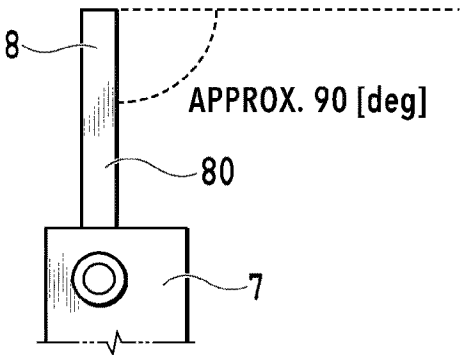
FIG. 10A is a view showing the wiper in a recovery process.
Figure 10B:
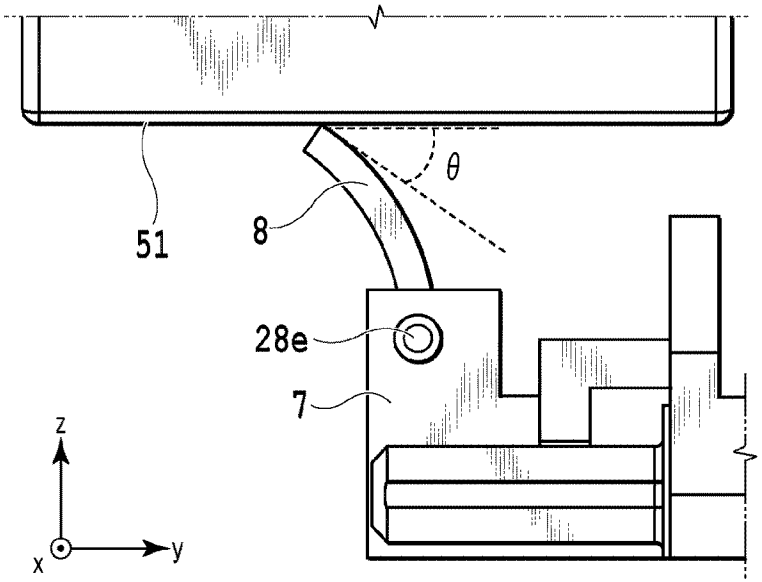
FIG. 10B is a view showing the wiper in the recovery process.
Figure 10C:
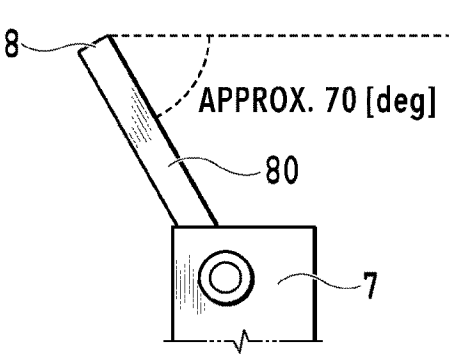
FIG. 10C is a view showing the wiper in a recovery process.
Figure 10D:
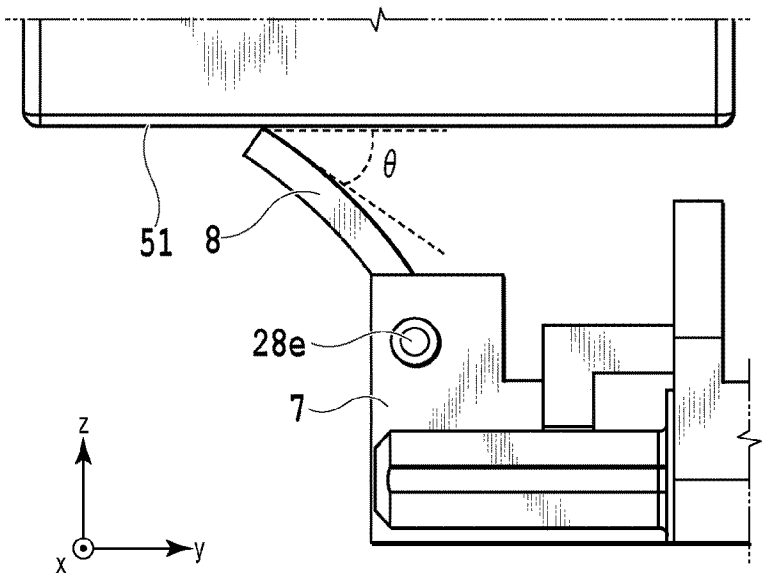
FIG. 10D is a view showing the wiper in the recovery process.

FIGS. 10A to 10D are views showing the states of the wiper 8 in the recovery process involving suction and in the recovery process not involving suction. The wiper 8 comprises a wiping surface 80 having an edge that contacts the ejection port surface during wiping. FIGS. 10A and 10B show the recovery process involving suction, which exerts a high wiping pressure (pressure) and is expected to achieve a strong recovery effect. On the other hand, FIGS. 10C and 10D show the recovery process not involving suction, which exerts a low wiping pressure and is expected to achieve a weak recovery effect.

In the recovery process required to achieve a strong recovery effect, the wiping is performed with the wiper 8 set at approximately 90 degrees by the effect of the adjustment slider 20, as shown in FIG. 10A. In the case where the wiping is performed with the wiper 8 set at approximately 90 degrees as mentioned above, the angle formed between the wiper 8 in a bent state and the ejection port surface 51 is an angle θ, as shown in FIG. 10B. Bending the wiper 8 to a predetermined extent provides a relatively strong, suitable wiping pressure.

On the other hand, in the recovery process required to achieve a weak recovery effect, the wiping is performed with the wiper 8 set at approximately 70 degrees by the effect of the adjustment slider 20, as shown in FIG. 10C. In the case where the wiping is performed with the wiper 8 set at approximately 70 degrees as mentioned above, the angle formed between the wiper 8 in a bent state and the ejection port surface 51 is the angle θ as in the recovery process required to achieve a strong recovery effect, as shown in FIG. 10D. Bending the wiper 8 to a predetermined extent as mentioned above provides a relatively weak, suitable wiping pressure. Here, the angle θ is an angle within an angle range suitable for wiping the ejection port surface with the wiper.

Note that the distance between the ejection port surface 51 and the slider 7 is the same in the recovery process required to achieve a strong recovery effect and the recovery process required to achieve a weak recovery effect. In other words, simply changing the angle of the wiper 8 switches between a wiping operation required to achieve a strong recovery effect and a wiping operation required to achieve a weak recovery effect. Thus, in the present embodiment, the wiping pressure during wiping is determined by the amount of bend of the wiper, and the angle of the wiper can be set at a suitable angle by the wiper fixed angle switching mechanism.

As described above, before executing a wiping operation, control to switch the angles of the wipers 8 and 9 according to whether the recovery operation involves an ink suction operation is performed in the state where the slider 7 is at the retreat position. For example, the case of executing the recovery process involving a suction operation includes a case where the printing apparatus has been left unused for a long period, a case where an abnormal termination occurs due to a paper jam, a power failure, or the like, a case where a strong recovery process is designated by a user command, and so on. Also, the case of executing the recovery process not involving a suction operation includes a case where a recovery process is performed in the middle of a printing operation, a case where a power off or a weak recovery process is designated by a user command, and so on.

In the case of the recovery process not involving suction, the amounts of inks attached to the ejection port surfaces 51 and 52 before the wiping operation are assumed to be small, and therefore a wiping operation at a low wiping pressure will sufficiently wipe the ejection port surfaces 51 and 52. On the other hand, in the case of the recovery process involving suction, the amounts of inks attached to the ejection port surfaces 51 and 52 before the wiping operation are assumed to be large, and therefore selected is the wiping of the ejection port surfaces 51 and 52 in a wiping operation at a high wiping pressure.

Figure 11A:
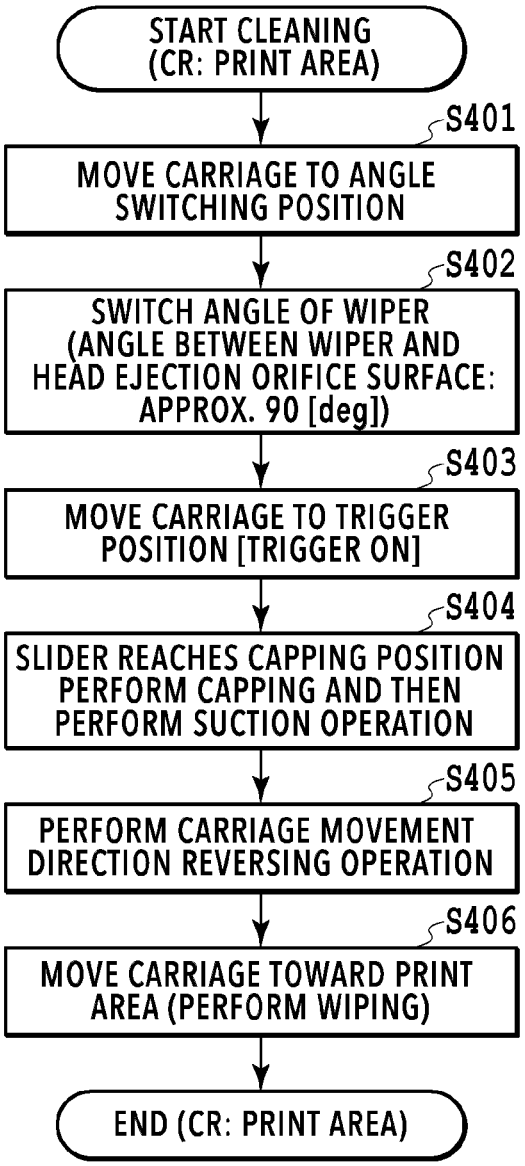
FIG. 11A is a flowchart of a recovery process.
Figure 11B:
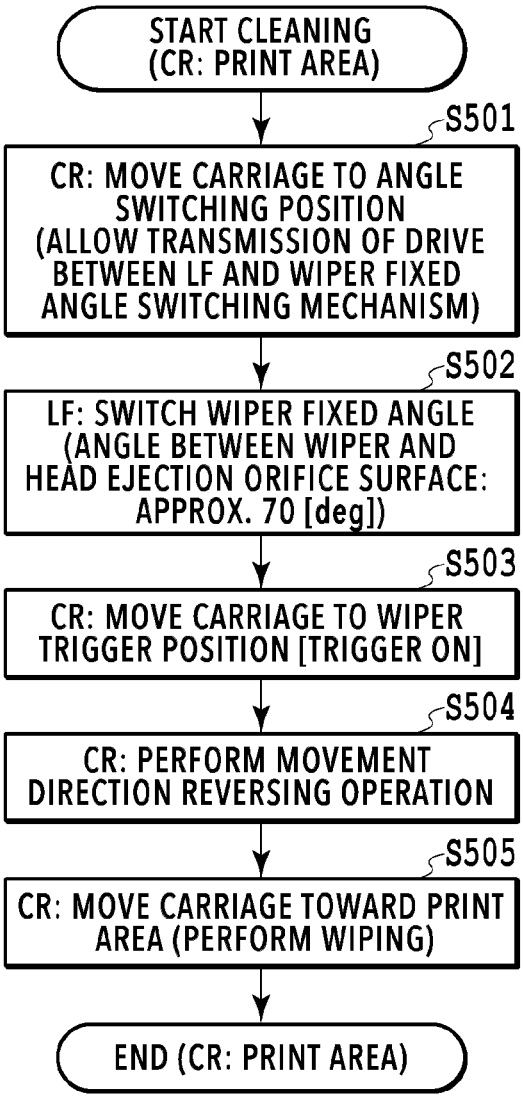
FIG. 11B is a flowchart of a recovery process.

FIG. 11A is a flowchart of the recovery process involving suction, and FIG. 11B is a flowchart of the recovery process not involving suction. The recovery process involving suction and the recovery process not involving suction will be described below by using these flowcharts. Note that the processes to be described here are performed by control by the MPU 201.

First, the recovery process involving suction in FIG. 11A will be described. Upon start of the recovery process involving suction, the carriage 6 is moved in the y direction, and the carriage 6 reaches the angle switching position in S401. The angle of the wiper 8 can now be changed by the angle switching drive transmission unit 105. In this state, the slider 7 is at the retreat position and out of contact with the carriage 6. Then in S402, the adjustment slider 20 is moved to set the wiper 8 at an angle of approximately 90 degrees. In a case where the wiper 8 is already at the desired angle (approximately 90 degrees), the drive force to slide the adjustment slider 20 is transmitted but the adjustment slider 20 remains unmoved. As the carriage 6 is moved further in the y direction, the side surface of the carriage 6 and the hitting portion 7*a* of the slider 7 contact each other. As a result, the slider 7 starts moving in the y direction by following the carriage 6. As the slider 7 moves in the y direction, it rises along the cam surfaces of the slider cams 13*a*.

Then in S403, the carriage 6 is moved to a later-described trigger position. As the slider 7 moves in they direction with the movement of the carriage 6, the tip portion 16*a* of the lock lever 16 at the release position gets separated from the locking portion 13*d* and is rotationally moved in the direction of arrow BB (see FIG. 8) by spring urging force. The position of the carriage 6 at this point is the trigger position. As the lock lever 16 is pivoted, the protrusion portion 16*f* of the lock lever 16 contacts the slider 7, so that the lock lever 16 is held at a restriction position.

Figure 12:
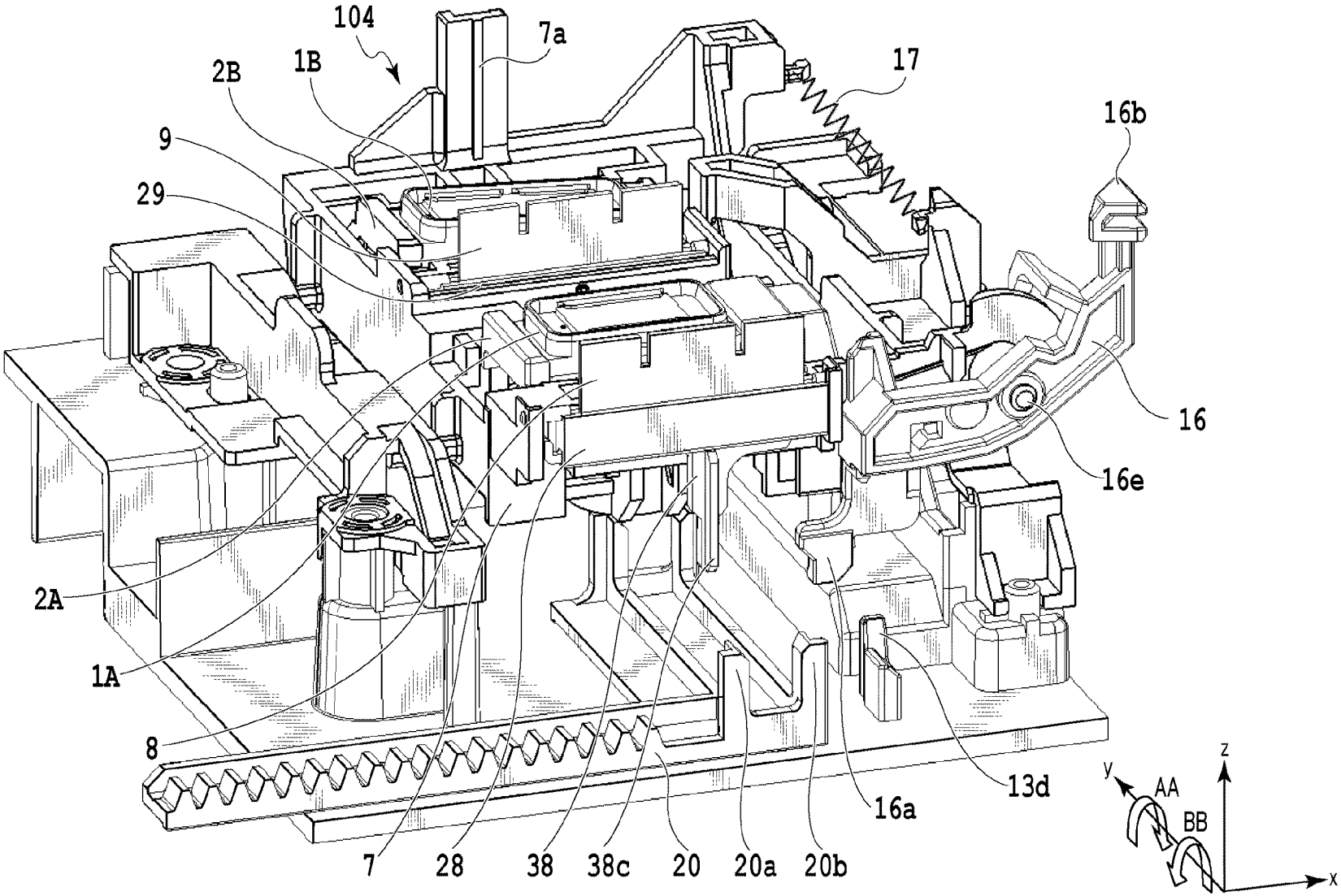
FIG. 12 is a perspective view showing the slider in a state where a carriage has been moved to a trigger position.

FIG. 12 is a perspective view showing the slider 7 in the state where the carriage 6 has been moved to the trigger position. As the carriage 6 is moved further in the y direction from the trigger position, and the slider 7 is disposed at the capping position in S404. As a result, the caps 1A and 1B cover the print heads of the print cartridges mounted on the carriage 6, and the suction recovery process is performed. Note that in FIG. 12, the cap 1B, covering the ejection port surface 52 of the print head 5B, is tilted.

The recovery mechanism 104 is capable of tilting the cap 1B as shown in FIG. 12. Tilting the cap 1B causes leakage between the cap 1B and the ejection port surface 52, so that a suction operation is substantially performed only on the ejection port surface 51 of the print head 5A, which is covered by the cap 1A. It is of course possible not to tilt the cap 1B and to perform a suction operation on both the ejection port surface 51 of the print head 5A and the ejection port surface 52 of the print head 5B. Note that the configuration may be such that the cap 1A is tilted to cause leakage from the cap 1A in its capping state, and a suction operation is performed only on the ejection port surface 52 of the print head 5B.

Figure 13:
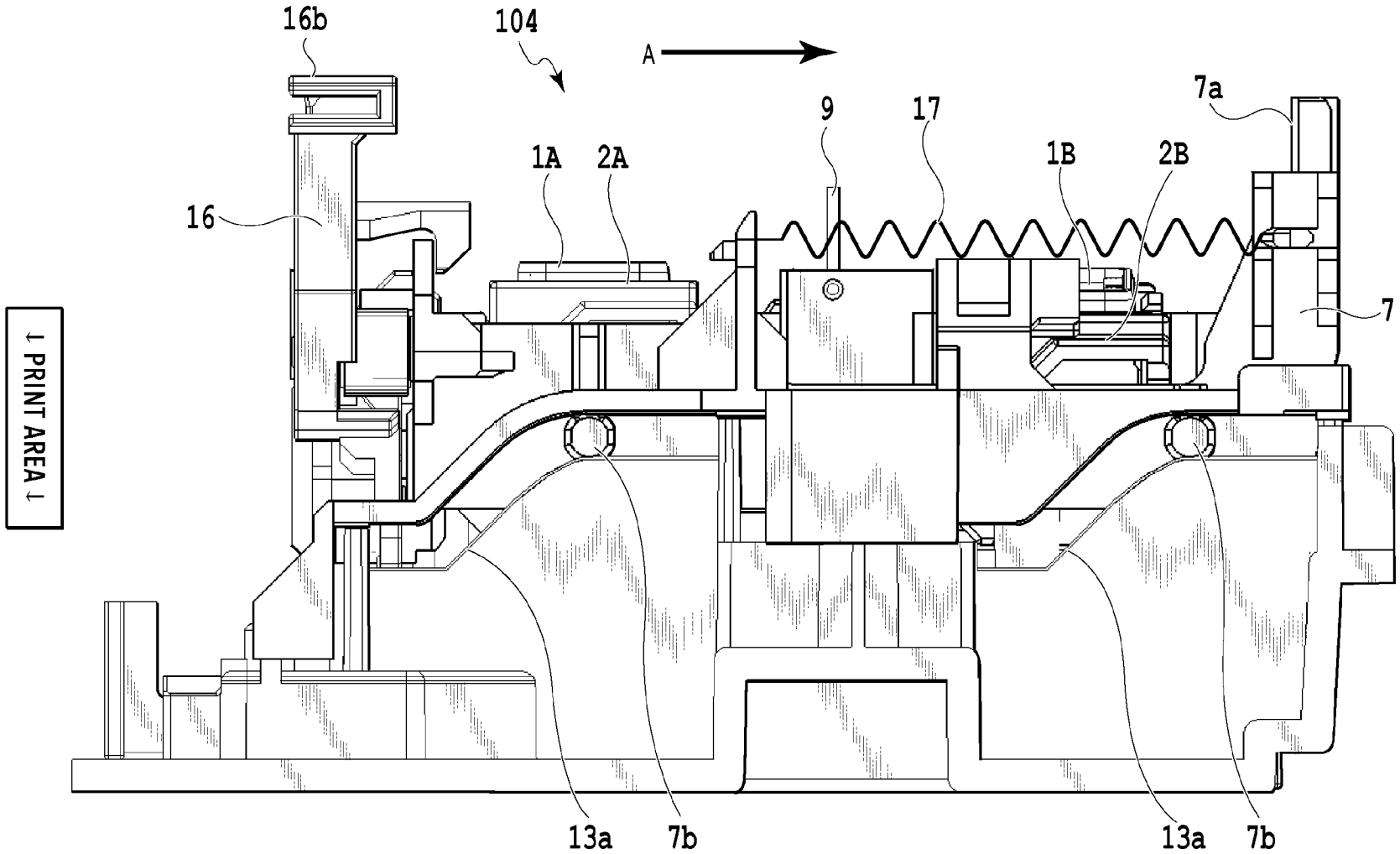
FIG. 13 is a side view showing a state where the slider is at a capping position.

FIG. 13 is a side view showing the state where the slider 7 is at the capping position. After the slider 7 is located at the capping position, the carriage 6 reverses its movement direction. In S405, the carriage 6 performs a movement direction reversing operation to switch the movement direction of the carriage 6 from the y direction to the –y direction. Then in S406, the carriage 6 is moved in the –y direction. As the carriage 6 reverses its movement direction and moves, the slider 7 starts moving to descend along the slider cams 13*a* with the spring urging force of the slider spring 17. As the slider 7 descends a predetermined amount, the tip portion 16*a* of the lock lever 16 contacts the locking portion 13*d*, so that the slider 7 is restricted from moving and stops at the wiping position. The carriage 6 and the slider 7 get separated from each other as the carriage 6 is moved further in the –y direction toward the print area with the slider 7 located at the wiping position.

During the further movement of the carriage 6 in the –y direction toward the print area, the wipers 8 and 9, which are mounted on the slider 7, slide on the ejection port surfaces 51 and 52 of the print heads 5, which are mounted on the carriage 6, so that a wiping operation is performed. In this operation, the wiper 8 wipes the color print head 5A, and the wiper 9 wipes the black print head 5B.

After the wiping operation on the ejection port surfaces 51 and 52 by the wipers 8 and 9 is completed as the carriage 6 is moved further in the −y direction toward the print area, the protrusion portion 67 of the carriage 6 contacts the upper end portion 16*b* of the lock lever 16. This rotationally moves the lock lever 16 about the support shaft 16*e* in the direction of arrow AA. As a result, the tip portion 16*a* of the lock lever 16 gets separated from the locking portion 13*d*, so that the lock on the slider 7 by the lock lever 16 is released. The slider 7 released from the lock is moved in the −y direction along the slider cams 13*a* back to the retreat position by the spring urging force of the slider spring 17. The series of operations in the recovery process is performed in this manner.

Next, the recovery process not involving suction in FIG. 11B will be described. S501 is similar to S401 in the recovery process involving suction in FIG. 11A. In S502, the adjustment slider 20 is moved to set the wiper 8 at an angle of approximately 70 degrees. Subsequently, S503 is similar to S403 in the recovery process involving suction, and S504 and S505 are similar to S405 to S406 in the recovery process involving suction.

Note that the angles of the wiper are set at two angles of approximately 90 degrees and approximately 70 degrees in the present embodiment, but are not limited to these angles. The configuration may only need to be such that the angles can be set at a plurality of different angles.

As described above, the configuration is such that the angle of the wiping surface of each wiper to the corresponding ejection port surface can be changed while the wiper is in a non-contacting state, thus not performing wiping, and the ejection port surface can be wiped with the wiper after the wiping surface angle is changed. In this manner, it is possible to implement a liquid ejection apparatus which, in a case of performing wiping operations at a plurality of different wiping pressures, can perform each wiping operation at a suitable wiping pressure and a suitable angle.

Note that a configuration that performs wiping while following movement of the carriage has been described in the present embodiment, but the configuration is not limited to this. It is possible to employ a configuration that performs wiping by moving the wipers with another drive relative to the carriage in a stopped state. Further, as for the wiping direction, the configuration is not limited to a configuration in which wiping is performed in the main scanning direction of the carriage as in the present embodiment, but may be a configuration in which wiping is performed in the conveyance direction, which crosses (is perpendicular to) the main scanning direction.

Furthermore, each print head of the liquid ejection apparatus 100 is a serial head which performs printing while being scanned over a print medium, but is also applicable to a full-line type line head in which ejection ports are arrayed over a length corresponding to the width of a print medium.

Second Embodiment

A second embodiment of the present invention will be described below with reference to drawings. Note that the basic configuration in the present embodiment is similar to that in the first embodiment, and only the characteristic configuration will therefore be described below.

Figure 14A:
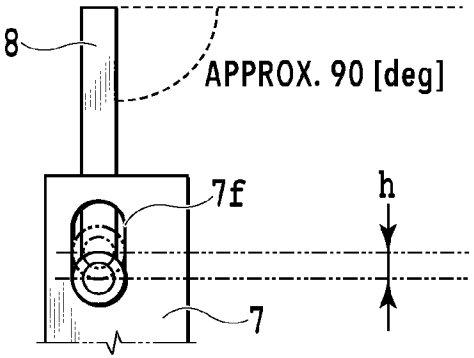
FIG. 14A is a view showing a wiper in a recovery process.
Figure 14C:
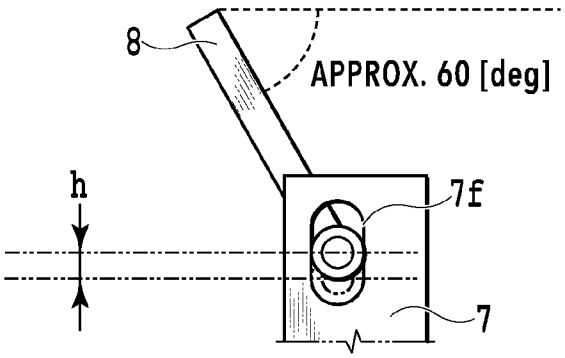
FIG. 14C is a view showing the wiper in a recovery process.
Figure 14B:
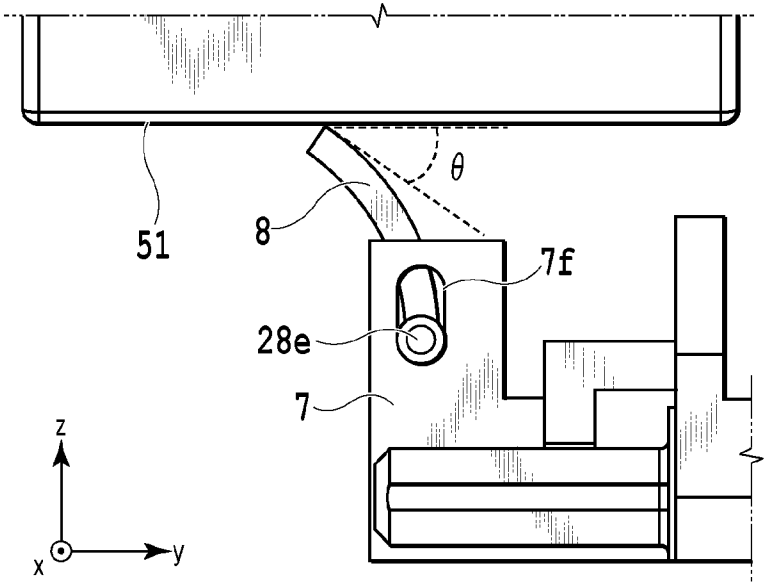
FIG. 14B is a view showing the wiper in the recovery process.
Figure 14D:
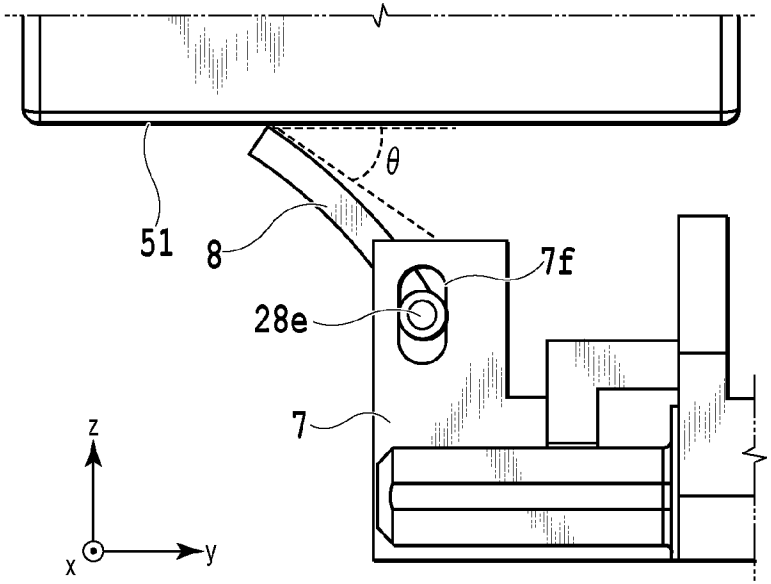
FIG. 14D is a view showing the wiper in the recovery process.
Figure 15A:
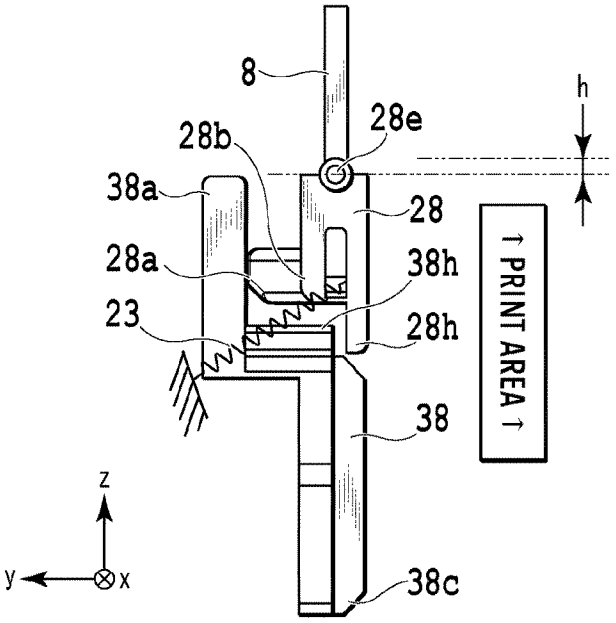
FIG. 15A is a view showing the wiper, a wiper holder, and an adjuster.
Figure 15B:
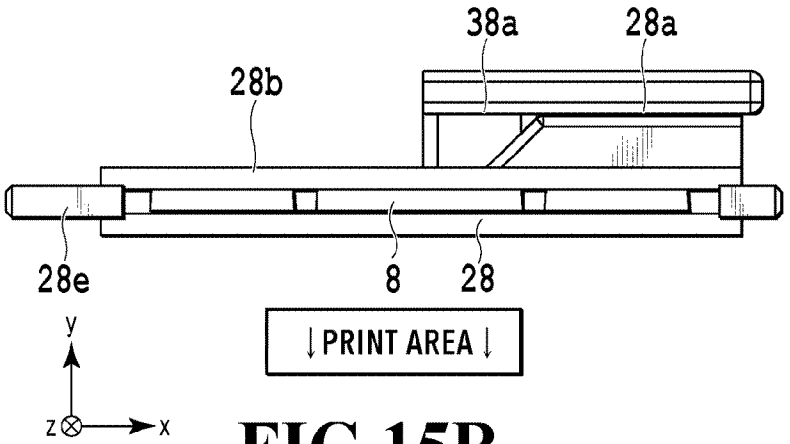
FIG. 15B is a view showing the wiper, the wiper holder, and the adjuster.
Figure 15C:
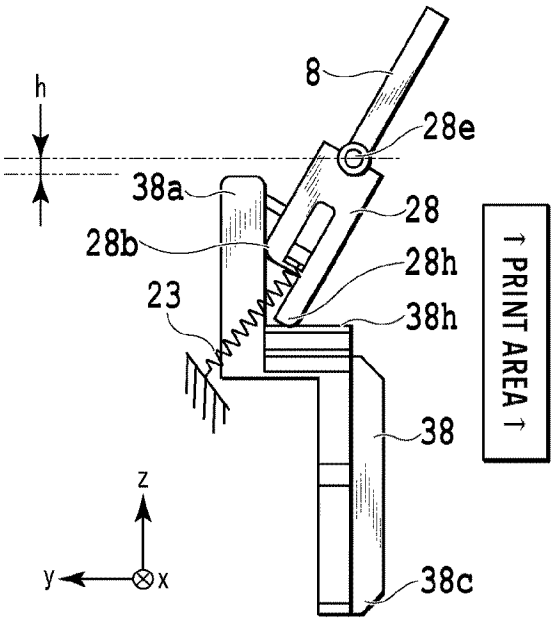
FIG. 15C is a view showing the wiper, the wiper holder, and the adjuster.
Figure 15D:
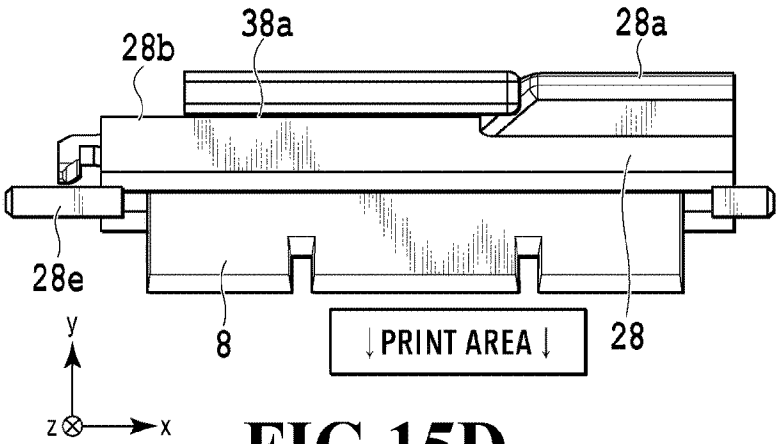
FIG. 15D is a view showing the wiper, the wiper holder; and the adjuster.

FIGS. 14A to 14D are views showing the states of the wiper 8 in the recovery process involving suction and in the recovery process not involving suction in the present embodiment. FIGS. 14A and 14B show the recovery process involving suction, which exerts a high wiping pressure and is expected to achieve a strong recovery effect. On the other hand, FIGS. 14C and 14D show the recovery process not involving suction, which exerts a low wiping pressure and is expected to achieve a weak recovery effect.

Also, FIGS. 15A to 15D are views showing the wiper 8, the wiper holder 28, and the adjuster 38. Note that in the present embodiment, like the first embodiment, the configuration of the wiper holder 29, to which the wiper 9 is attached, is similar to the configuration of the wiper holder 28, to which the wiper 8 is attached. Thus, only the wiper 8 and the wiper holder 28 will be described below, and description of the wiper 9 and the wiper holder 29 will be omitted.

In the present embodiment, the support shaft 28*e* of the wiper holder 28 is configured to be movable in the ±z directions. As the adjuster 38 slides, the cam surface of the wiper holder 28 in contact with the contact portion 38*a* of the adjuster 38 switches between the cam surface 28*a* and the cam surface 28*b*. As a result, the wiper 8 rotationally moves about the support shaft 28*e* of the wiper holder 28.

A bearing hole 7*f* in the slider 7 holding the wiper holder 28 is in an elongated hole shape whose longitudinal direction is the z direction, and the support shaft 28*e* is movable in the ±z directions (see FIGS. 14A and 14B). Further, the angle of the wiper 8 can be changed to approximately 90 degrees or approximately 60 degrees by switching between a state where a height adjustment portion 28*h* of the wiper holder 28 and a height adjustment portion 38*h* of the adjuster 38 contact each other and a state where they do not contact each other simultaneously with rotational movement about the support shaft 28*e*.

In the first embodiment, in comparison between the case where the angle of the wiper 8 is changed to approximately 90 degrees and the case where the angle is changed to approximately 70 degrees, the height position of the tip of the wiper 8 is lower in the case where the wiper 8 is tilted at approximately 70 degrees since the wiper 8 pivoted about the same axis. In the present embodiment, the support shaft 28*e* is moved in the z direction, so that the height position of the tip of the wiper 8 can be set at the same position in the case where the angle of the wiper 8 is changed to approximately 90 degrees and in the case where the angle of the wiper 8 is changed to approximately 70 degrees. Further, by setting the tilt angle of the wiper 8 at approximately 60 degrees, the amount of bend of the wiper 8 during contact with the ejection port surface 51 is smaller than that in the first embodiment, so that a lower wiping pressure than in the first embodiment is achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-015871 filed Jan. 31, 2019, which is hereby incorporated by reference wherein in its entirety.

What is claimed is:

1. A liquid ejection apparatus comprising:

a print head having an ejection port surface in which an ejection port for ejecting a liquid is provided;

a wiper that has a wiping surface capable of contacting with the ejection port surface and performs a wiping operation of wiping the ejection port surface via relative movement between the wiper and the print head;

an angle changing unit configured to change a fixed angle of the wiping surface to the ejection port surface in a state where the wiping surface is out of contact with the ejection port surface; and a wiper holder that supports the wiper and has a first cam surface and a second cam surface both capable of contacting the angle changing unit, wherein a distance to the ejection port surface from a tip of the wiper is changed in the state where the wiping surface is out of contact with the ejection port surface, and wherein the angle changing unit is configured to set the fixed angle to a first angle by contact to the first cam surface, and is configured to set the fixed angle to a second angle smaller than the first angle by contact to the second cam surface.

2. The liquid ejection apparatus according to claim 1, wherein the fixed angle is changed by pivoting the wiper about a shaft provided in the wiper holder.

3. The liquid ejection apparatus according to claim 2, wherein the shaft is supported by an elongated hole whose longitudinal direction is a direction in which the wiper is moved toward or away from the ejection port surface.

4. The liquid ejection apparatus according to claim 1, further comprising a carriage that moves with the print head mounted thereon; and a slider to which the wiper is attached and moves by following movement of the carriage.

5. The liquid ejection apparatus according to claim 4, further comprising a restriction unit that restricts movement of the slider.

6. The liquid ejection apparatus according to claim 5, wherein the restriction unit comprises a contact portion that contacts the carriage, and releases the restriction on the movement of the slider by contacting the carriage with the contact portion.

7. The liquid ejection apparatus according to claim 5, wherein the wiper performs the wiping operation via movement of the carriage with the slider restricted by the restriction unit.

8. The liquid ejection apparatus according to claim 4, wherein the angle changing unit is capable of moving the slider in such a direction as to bring the wiper toward or away from the ejection port surface with movement of the carriage.

9. The liquid ejection apparatus according to claim 8, wherein the angle changing unit is capable of changing the fixed angle in a case where the slider is separated from the ejection port surface and located at a retreat position.

10. The liquid ejection apparatus according to claim 1, wherein the print head has a first ejection port surface in which an ejection port for ejecting a first ink is disposed, and a second ejection port surface in which an ejection port for ejecting a second ink is disposed, and the wiper includes a first wiper that wipes the first ejection port surface and a second wiper that wipes the second ejection port surface.

11. The liquid ejection apparatus according to claim 10, further comprising a carriage that moves with the print head mounted thereon; and a slider to which the wiper is attached and moves by following movement of the carriage, wherein the slider has a first cap that covers the first ejection port surface and a second cap that covers the second ejection port surface.

* * * * *